United States Patent [19]

Caraballo

[11] Patent Number: 4,964,819

[45] Date of Patent: Oct. 23, 1990

[54] TERMINAL CONNECTOR CLAMP

[76] Inventor: Damian F. Caraballo, 1250 Chorus Way, Royal Palm Beach, Fla. 33411

[21] Appl. No.: 394,128

[22] Filed: Aug. 15, 1989

[51] Int. Cl.[5] ..... H01R 13/631

[52] U.S. Cl. ..... 439/773

[58] Field of Search ..... 439/772–774, 439/769, 754

[56] References Cited

U.S. PATENT DOCUMENTS

| | | | |
|---|---|---|---|
| 1,868,939 | 7/1932 | Conrad | 439/769 |
| 2,589,122 | 3/1952 | Olson . | |
| 2,706,284 | 4/1955 | Hoggatt et al. | 439/772 |
| 3,084,306 | 4/1963 | Cribbs | 439/773 |
| 3,644,876 | 2/1972 | Thomas . | |
| 3,694,799 | 9/1972 | Shannon et al. . | |
| 4,537,460 | 8/1985 | McCaig | 439/773 |
| 4,747,793 | 5/1988 | Fukuda et al. | 439/766 |

FOREIGN PATENT DOCUMENTS

| | | | |
|---|---|---|---|
| 605717 | 9/1960 | Canada | 439/773 |
| 722313 | 11/1965 | Canada | 439/773 |
| 572866 | 9/1977 | U.S.S.R. | 439/773 |

*Primary Examiner*—Gary F. Paumen

*Attorney, Agent, or Firm*—Eckert Seamans Cherin & Mellott

[57] ABSTRACT

A terminal connector clamp includes opposing, first and second terminal connector flanges and aligned apertures in the flanges adapted for the reception of a connecting shaft. A connecting shaft having a long axis is adapted for placement through the apertures and has at one end a stop member adapted to engage an outside surface of the first connector flange. A first cam member is operatively connected to an opposite end of the connecting shaft and is rotatable substantially about the long axis of the connecting shaft. A second cam member abuts an outside surface of the second connector flange and has a second cam surface, the second cam surface being substantially juxtaposed to the first cam surface. Rotation of one of the first cam member and second cam member causes sliding contact between the respective cam surfaces, and axial movement of the second cam member and the second connector flange away from the first cam member and toward the first connector flange to close the connector flanges against the terminal post. The invention can be provided as an add-on device for existing terminal connector clamps, as an integral terminal connector clamp construction, or a battery cable construction. A method for practicing the invention is also disclosed.

13 Claims, 2 Drawing Sheets

TERMINAL CONNECTOR CLAMP

BACKGROUND OF THE INVENTION

1. Field of the Invention

This invention relates generally to battery connection devices, and more particularly to battery terminal post connector devices.

2. Description of the Prior Art

Battery conductor cables typically are attached to the battery terminal post by a terminal connector clamp. The terminal connector clamp has a base that is electrically connected to an end of the battery conductor cable. The terminal connector clamp has opposing terminal connector flanges with aligned apertures adapted to receive a bolt. Inner, curvilinear surfaces can be provided on the terminal connector flanges to engage the generally cylindrical terminal posts. A nut is threaded onto the bolt to force the terminal connector flanges against one another to engage the terminal post.

Present terminal connector clamps are messy and difficult to use in practice. The tightening bolt or nut often becomes tightly engaged to the terminal connector clamp, and sometimes is partially embedded in the soft lead of the terminal connector flange. It is difficult to fit a wrench onto the tightening nut, which often becomes worn or corroded, and frequently is located in close quarters where wrenches are not easily usable. Properly sized tools are sometimes not available to adequately grip the bolt and tightening nut. In any event, several turns of the nut are often necessary to sufficiently loosen or tighten the terminal connector clamp.

It would be desirable to provide a battery terminal connector clamp which would allow quick connection and disconnection of conductor cables to lead storage cell batteries.

It would further be desirable if such a device would not require the use of a wrench or other tool device. It would additionally be desirable that such a device be easily installed in existing conductor cable constructions.

SUMMARY OF THE INVENTION

It is an object of the invention to provide a terminal connector clamp construction which will permit the ready connection and disconnection cf electrical conductor cables to batteries, and particularly batteries with terminal posts.

It is another object of the invention to provide an assembly which will not require the use of a wrench or other tool to connect or disconnect the terminal connector clamp to the terminal post of the battery.

It is yet another object of the invention to provide a terminal connector clamp construction in which existing terminal connector clamps can be readily modified to that of the invention.

These and other objects are accomplished by a terminal connector clamp having opposing, first and second terminal connector flanges. The terminal connector flanges have aligned apertures for the reception of fastening structure adapted to press the opposing flanges together to engage the terminal post of the battery. A connecting shaft having a long axis is adapted for placement through the apertures. The connecting shaft has, at one end, a stop adapted to engage an outside surface of a first connector flange. A first cam member having a first cam surface is operatively connected to substantially an opposite end of the connecting shaft, and is rotatable substantially about the long axis of the connecting shaft. A second cam member abuts an outside surface of the second connector flange and has a second cam surface, the second cam surface being substantially juxtaposed to the first cam surface of the first cam member. Rotation of one of the first cam member and the second cam member relative to one another will cause sliding contact between the first cam surface and the second cam surface, and axial movement of the second cam member relative to the first cam member along the long axis of the connecting shaft. This will press the terminal connector flanges between the stop and the cam members to tighten the connector flanges around the terminal post.

In a preferred embodiment, the first cam member has a mounting aperture adapted to receive the connecting shaft. An end of the connecting shaft has a head dimensioned to prevent passage through the mounting aperture, such that the first cam member will be rotatably mounted to the connecting shaft. The second cam member also has a mounting aperture adapted to receive the connecting shaft. The second cam member abuts the second terminal connector flange. A lever is attached to the first cam member, whereby rotation of the lever and first cam member will cause sliding contact between the first cam surface and the second cam surface. The second cam member and second connector flange will be axially advanced along the connecting shaft toward the stop and will tighten the connector flanges about the terminal post.

The stop is preferably detachable from the connecting shaft. The shaft can have male threads substantially at one end. The stop can be provided as a stop member having a mounting aperture with female threads adapted to cooperatively engage the male threads of the connecting shaft. The stop member can thereby be threadably engaged to the connecting shaft, and its position on the connecting shaft can be adjusted to provide a coarse adjustment with respect to the terminal connector flanges. The stop member can also thereby be removed to permit attachment and replacement of the connecting shaft through the aligned aperture.

BRIEF DESCRIPTION OF THE DRAWINGS

There are shown in the drawings embodiments which are presently preferred, it being understood, however, that the invention is not limited to the precise arrangements and instrumentalities shown wherein.

DETAILED DESCRIPTION OF THE PREFERRED EMBODIMENTS

Figure 1:
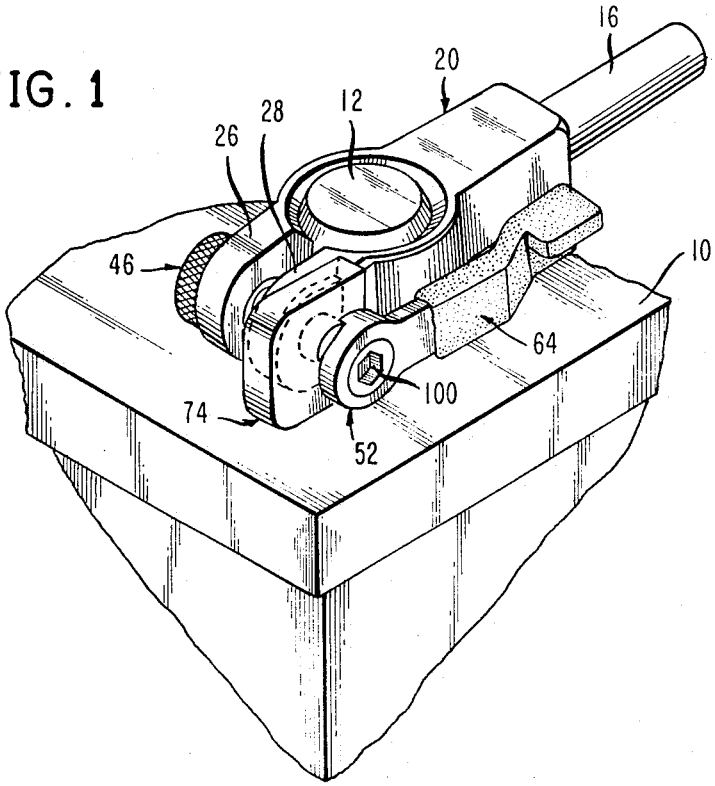
FIG. 1 is a perspective view of a terminal connector clamp according to the invention.
Figure 2:
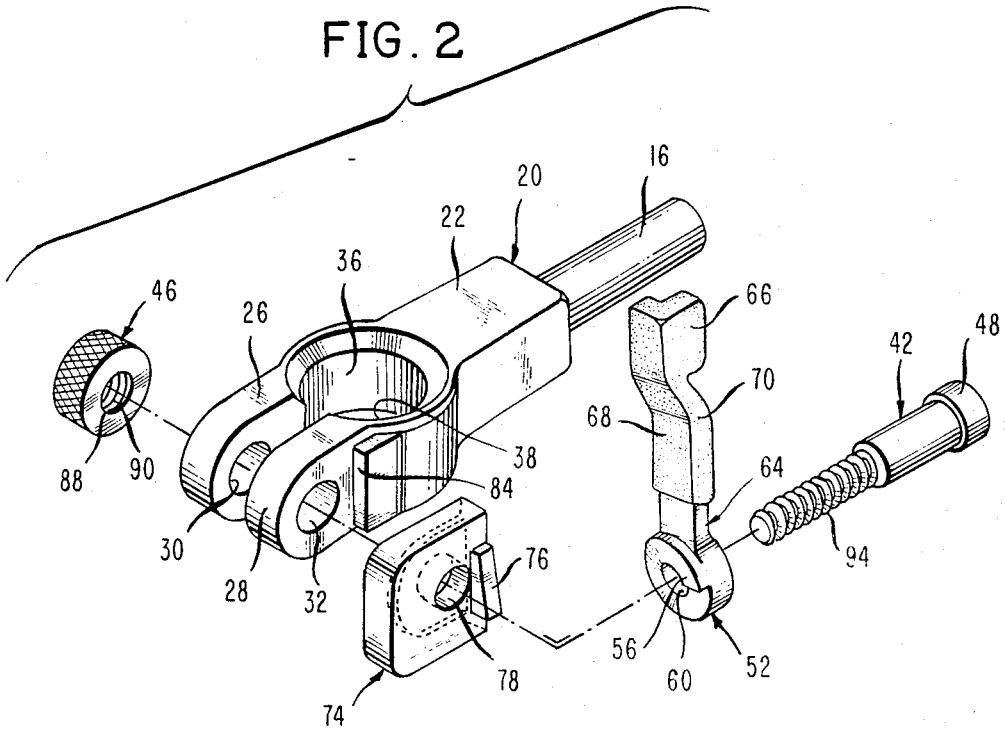
FIG. 2 is an exploded perspective of a terminal connector clamp according to the invention.

There are shown in FIGS. 1–4 a terminal connector clamp assembly according to the invention. The invention can be utilized with several alternative electrical connections and battery constructions having terminal posts, but most typically will be used with a lead storage cell battery 10. The lead storage cell battery 10 typically includes a terminal post 12, which is commonly cylindrical and can be either the anode or the cathode of the battery. An electrical conductor cable 16 will normally be provided for electrical connection of the battery 10 with remaining portions of the motor or engine. A terminal connector clamp 20 is provided at an end of the conductor cable 16 for engaging the terminal post 12.

The terminal connector clamp 20 typically includes a base 22 which is electrically connected to the conductor cable 16. Opposing first and second terminal connector flanges 26, 28 respectively, are joined to the base 22. The opposing first terminal connector flange 26 and second terminal connector flange 28 can have aligned apertures 30, 32 respectively, which are provided for the reception of fastening means such as a nut and bolt for pressing the flanges together against the terminal post 12. Inner curvilinear surfaces 36, 38 can be formed on the first and second terminal connector flanges 26, 28 for snugly engaging the terminal post 12.

According to the invention, the nut and bolt of terminal connector clamps are replaced by a connecting shaft 42 and stop member 46. The connecting shaft 42 is adapted to be positioned through the apertures 30, 32. The stop member 46 is secured to a first end of the connecting shaft 42, and a head 48 can be provided as a stop means at an opposite end of the connecting shaft 42.

A first cam member 52 is mounted to the connecting shaft 42 so as to be rotatable about the long axis defined by the connecting shaft 42. The first cam member 52 has a first c am surface 56, which is preferably helical. A mounting aperture 60 is provided for the passage of the connecting shaft 42. A lever arm 64 can be constructed with a bend 70 which will allow the lever arm to snugly fit the profile of the terminal connector clamp 20. The lever arm 64 is provided to facilitate rotation of the first cam member 52 about the long axis of the connecting shaft 42. A tab portion 66 can be provided for a better grip. The lever arm 64 can also include an insulating covering 68 to provide a better grip, and to prevent accidental shorting. The insulating covering 68 can be color-coded to indicate electrical polarity such as black for the negative terminal, and red for the positive terminal.

A second cam member 74 includes a second, inclined cam surface 76. The second cam member 74 can be directly fixed to the second terminal connector flange 28, but most preferably includes a mounting aperture 78 which is adapted to receive the connecting shaft 42. Many terminal connectors have a recess 84 formed in one or both of the terminal connector flanges, and it is also possible to dimension the second cam member 74 to fit into and engage this recess.

Figure 3:
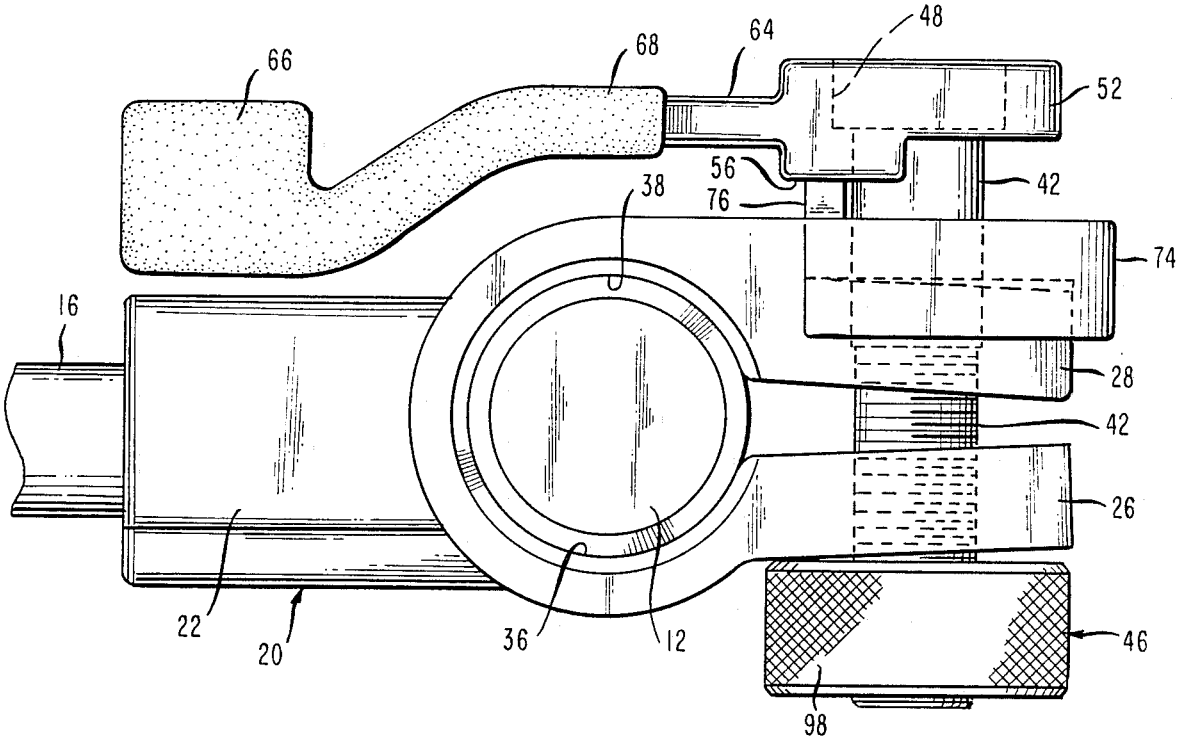
FIG. 3 is a plan view in a first, closed configuration.

The first cam member 52 and second cam member 74 are positioned on the connecting shaft 42 such that the first cam surface 56 and the second cam surface 76 are juxtaposed. Rotation of the first cam member 52 about the long axis of the connecting shaft 42 will cause sliding contact between the first cam surface 56 and the second cam surface 76 which will cause axial movement of the second ca member 74 from the first cam member 52. The first cam member 52 being fixed in position by the head 48 against reactive movement, the second cam member 74 will act against the second terminal connector flange 28 to squeeze the terminal connector flanges against the stop 46, and to tighten the terminal connector clamp 20 against the terminal post 12 (FIG. 3).

Figure 4:
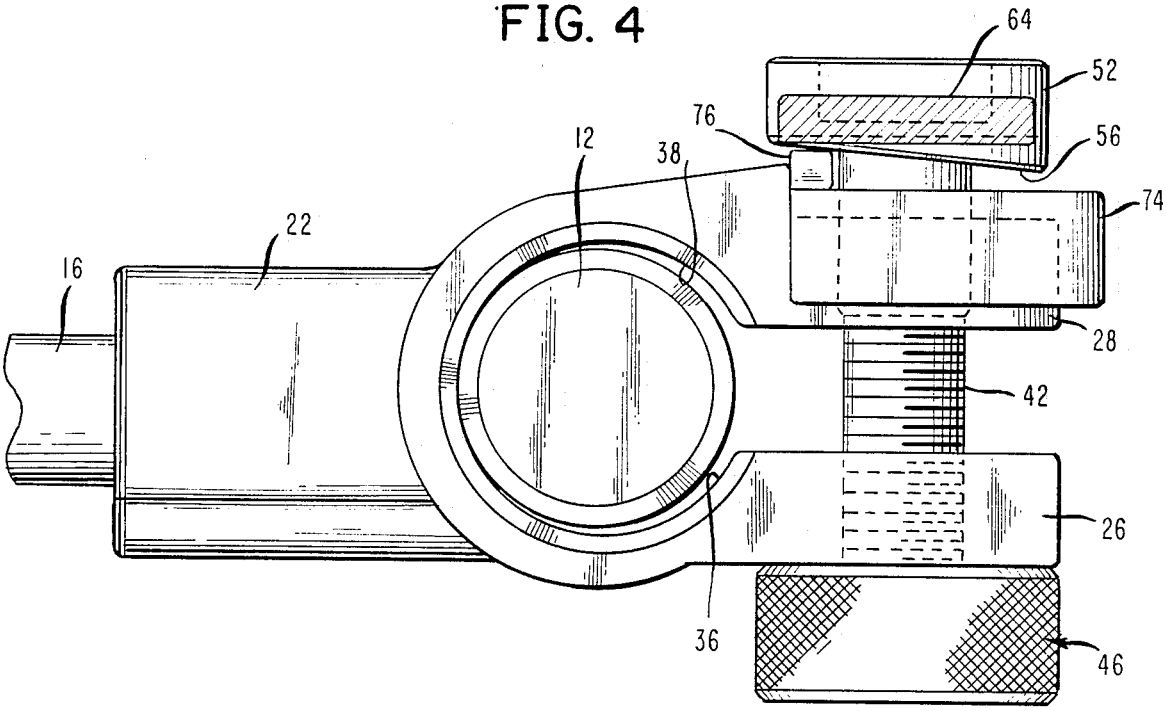
FIG. 4 is a plan view, partially broken away, of a second, open configuration.

Opposite rotation of the lever arm 64 will move the respective first and second cam surfaces 46 and 76 away from one another (FIG. 4). This will permit movement of the second cam member 74 toward the first cam member 52, and a relaxation of pressure on the second terminal connector flange 28 and the terminal post 12. The lever arm 64 can be rotated substantially 180 degrees away from the closed position depicted in FIG. 3, wherein the lever arm 64 can be manipulated to pry the terminal connector flanges apart.

The stop 46 can include a mounting aperture 88 which can have female threads 90. The connecting shaft 42 can have male threads 94, which are adapted to engage the female threads 90 on the stop member 46. In this manner, the stop member 46 can be threadably adjusted on the connecting shaft 42 to provide a coarse adjustment of the position of the stop member 46 relative to the connector flange 26. A knurled surface 98 can be provided on the stop 46 to facilitate manipulation of the stop 46. Also, the stop member 46 can be detached from the connecting shaft 42 to permit attachment and detachment of the invention to standard battery terminal clamps. An Allen wrench fitting 100, or other tool fitting, can be provided on an end of the connecting shaft 42 to permit detachment of the connecting shaft 42 and stop member 46, where the same have become frozen in place.

It is possible to provide the invention, as shown, in an add-on device suitable for modifying existing battery terminal connector clamps. The connecting shaft 42, stop member 46, first cam member 52 and second cam member 74 can be added to the connector clamp 20 quickly and with no tools. It would alternatively be possible, however, to construct a terminal connector clamp 20 according to the invention. This integral construction could include the battery conductor cable. In this embodiment, the second cam member 74 could be cast integrally with the second connector flange 28. Alternatively, the second cam member 74 could be otherwise fastened to the connector flange 28 at the factory.

Generally, the second cam member 74 must be made of a more rigid material than lead to prevent marring of the second cam surface 76 during use. The other components of the invention are preferably constructed of durable, rust-resistant materials such as stainless steel.

In operation, the stop member 46 is threadably rotated on the connecting shaft 42 to a position where it abuts an outside surface of the first terminal connector flange 26 (FIG. 4). The lever arm 64 will typically in this position be "up". The first cam surface 56 and second cam surface 76 will be substantially juxtaposed, but without making contact or with contact only between the narrow dimension of each cam surface. Rotation of the lever arm 64 in the clockwise position to a position substantially adjacent the terminal connector clamp 20 (FIG. 3) will cause sliding contact between the first cam surface 56 and the second cam surface 76. This will cause the second cam member 74 to move axially from the first cam member 52, and will cause the second cam member 74 to contact the second connector flange 28. The first connector flange 26 and second connector flange 28 will thereby be pressed between the second cam member 74 and the stop member 46. The curvilinear surfaces 36, 38 will be pressed tightly against the terminal post 12 to firmly engage the connector clamp 20 to the terminal post 12.

When it is desired to remove the terminal connector clamp 20 from the terminal post 12, the lever arm is again lifted to the position shown in FIG. 4. The first cam surface 56 is rotated away from the second cam surface 76, allowing the second cam member 74 to move axially toward the first cam member 52. This will relax pressure on the first connector flange 26 and second terminal connector flange 28, and thereby on the curvilinear surfaces 36, 38. The connector can thereby be removed. The lever arm 64 can be utilized to pry apart the terminal connector flanges, if necessary. It will be appreciated that as the device becomes worn, the stop member 46 can be rotated tightly against the first connector flange 26 to adjust the gripping strength of the assembly.

This invention can be embodied in other specific forms without departing from the spirit or essential attributes thereof. The cam surfaces can be shaped or dimensioned differently, for example, and the connections and positions among the various parts can be modified without departing from the principle of a rotating cam on a connecting shaft that has been disclosed herein. Accordingly, reference should be had to the following claims, rather than to the foregoing specification, as indicating the scope of the invention.

I claim:

1. A tool-free kit for closing terminal connector clamps of the type having opposing first and second terminal connector flanges, with aligned apertures in said flanges adapted for the reception of a fastener, said kit being adapted for retrofit application to said terminal connector clamps, said kit comprising:

a connecting shaft having a long axis adapted for placement through said aligned apertures of said connector flanges, said connecting shaft having a first end thereof, and a first stop member adapted to engage said first end of said connector shaft, said first stop member being adapted to engage an outside surface of said first connector flange, and being dimensioned to prevent removal of said connecting shaft through said aligned apertures, said connecting shaft having at a second end thereof a second stop member;

a lever member adapted to be connected to said second end of said connecting shaft so as to freely rotate about the long axis of said connecting shaft, and substantially abut said second stop member, said lever member having a first inclined surface;

a wedge member adapted to abut and engage said second connector flange and adapted to be substantially juxtaposed to said lever member, said wedge member having a second inclined surface, said second inclined surface of said wedge member adapted to be substantially juxtaposed to said first inclined surface of said lever member, whereby rotation of the lever member about the connecting shaft, and through a throw path of about ninety degrees, will cause sliding contact between the first inclined surface of the lever member and the second inclined surface of the wedge member, and will cause axial movement of the wedge member along the axis of the connecting shaft, to force said second connector flange towards said first connector flange to close said terminal connector clamp.

2. The tool-free kit of claim 1, wherein said nut is knurled.

3. The tool-free kit of claim 1, wherein said wedge member comprises an aperture, said connecting shaft passing through said aperture.

4. The tool-free kit of claim 3, wherein said outside surface of said second connector flange comprises a recess, said wedge member being adapted to fit into said recess so as to operatively engage said second connector flange to prevent rotation of said wedge member with rotating contact by said lever member.

5. The tool-free kit of claim 1, wherein said first stop member is detachable from said connecting shaft and axially moveable along said connecting shaft.

6. The tool-free kit of claim 1, wherein at least one of said inclined surface on said lever member and said inclined surface on said wedge member is arcuate and substantially concentric with said connecting shaft.

7. A tool-free terminal connector clamp assembly, comprising:

a terminal connector clamp having opposing first and second terminal connector flanges with aligned apertures in said flanges adapted for the reception of fastening means for engagement with a battery terminal post;

a connecting shaft having a long axis adapted for placement through said aligned apertures, said connecting shaft having at a first end a first stop member adapted to engage an outside surface of said first connector flange, and having at a second end a second stop member;

a lever member rotatably connected to said second end of said connecting shaft and substantially abutting said second stop member, said lever member having a first inclined surface;

a wedge member abutting an outside surface of said second connector flange and being substantially juxtaposed to said lever member, said wedge member having a second inclined surface, said inclined surface of said wedge member being substantially juxtaposed to said inclined surface of said lever member, whereby rotation of the lever member about the long axis of the connecting shaft, through a throw path of about ninety degrees, will cause sliding contact between the inclined surface of the lever member and the inclined surface of the wedge member, and will cause axial movement of the wedge member along the long axis of the connecting shaft, to force said second connector flange toward said first connector flange to close said terminal connector clamp.

8. The tool-free apparatus of claim 7, wherein said first end of said connecting shaft is threaded, and said first stop member is a nut adapted to threadably engage said first end of said connecting shaft.

9. The tool-free apparatus of claim 8, wherein said nut is knurled.

10. The tool-free apparatus of claim 7, Wherein said wedge member comprises an aperture, said connecting shaft passing through said aperture.

11. The tool-free apparatus of claim 10, wherein said outside surface of said second connector flange comprises a recess, said wedge member being adapted to fit into said recess so as to operatively engage said second connector flange to prevent rotation of said wedge member with rotating contact by said lever member.

12. The tool-free apparatus of claim 7, wherein said first stop means is detachable from said connecting shaft and axially moveable along said connecting shaft.

13. The tool-free apparatus of claim 7, wherein at least one of said inclined surface on said lever member and said inclined surface on said wedge member is arcuate and substantially concentric with said connecting shaft.

* * * * *